US005136921A

United States Patent [19]

Büchel

[11] Patent Number: 5,136,921

[45] Date of Patent: Aug. 11, 1992

[54] DRIVING TOOL WITH SPRING CLIP

[75] Inventor: Franz Büchel, Rugell, Liechtenstein

[73] Assignee: Hilti Aktiengesellschaft, Fürstentum, Liechtenstein

[21] Appl. No.: 697,650

[22] Filed: May 8, 1991

[30] Foreign Application Priority Data

May 14, 1990 [DE] Fed. Rep. of Germany ..... 4015449

[51] Int. Cl.[5] ..... B25C 1/14

[52] U.S. Cl. ..... 89/1.14; 227/9

[58] Field of Search ..... 89/1.14; 227/9-11

[56] References Cited

U.S. PATENT DOCUMENTS

| | | | |
|---|---|---|---|
| 4,134,527 | 1/1979 | Termet | 227/10 |
| 4,830,252 | 5/1989 | Gottlieb et al. | 227/10 |
| 4,848,209 | 7/1989 | Halmeras | 89/1.14 |
| 4,867,365 | 9/1989 | Buechel et al. | 227/10 |
| 4,898,315 | 2/1990 | Vemerey | 227/9 |

FOREIGN PATENT DOCUMENTS

| | | | |
|---|---|---|---|
| 1170880 | 9/1959 | Fed. Rep. of Germany | 227/10 |
| 2263764 | 12/1972 | Fed. Rep. of Germany | 227/10 |

*Primary Examiner*—David H. Brown
*Attorney, Agent, or Firm*—Akoo-Toren

[57] ABSTRACT

An explosive powder charge operated setting tool has a housing (1) including an axially extending housing section (5) enclosing a driving piston guide tube (8) axially displaceable within the housing section. The guide tube (8) is held in a neutral position by a spring clip (15, 16). The spring clip (15, 16) is U-shaped and engages at a first end (15*a*, 16*a*) radially inwardly of the housing section (5) into a recess (8*c*, 8*d*) of the guide tube and bears against a shoulder (8*e*) at one end of the recess (8*c*, 8*d*). The second end (15*c*, 16*c*) of the spring clip (15, 16) extends tangentially of and in prestressed contact with an outside surface of the housing section (5) and is diametrically opposite the first end (15*a*, 16*a*).

4 Claims, 2 Drawing Sheets

DRIVING TOOL WITH SPRING CLIP

BACKGROUND OF THE INVENTION

The present invention is directed to an explosive powder charge operated driving tool with a guide tube for a driving piston axially displaceable within a housing and with at least one spring clip mounted in the housing at least partially embracing a generally cylindrically shaped housing section. The spring clip contacts the housing section with prestress. The spring clip has a first end projecting radially inwardly of the housing section into a recess in the piston guide tube and contacts a shoulder at a trailing end of the recess.

It is generally known in explosive powder charge operated driving tools to retain the guide tube for a driving piston by appropriate means so that it is held against a locking piece at the trailing end of the guide tube in the tool.

A spring clip, used as retention means and easy to assemble in a tool, is shown in DE-PS 1 923 050. The spring clip is held in the housing so that it can not be displaced in the axial or driving direction of the tool and surrounds with prestress a generally cylindrically shaped housing section. The spring clip has two bent-off ends disposed diametrically opposite one another with the ends projecting into the guidance region of the housing section. Accordingly, the ends grip behind a shoulder of the guide tube on the driving direction side.

A considerable disadvantage of this known arrangement is that the spring clip must be widened for installation on the housing section by a distance corresponding to the width of the bent-off ends. As a result, the high forces acting counter to the prestress must be overcome during installation, complicating the assembly process. In addition, the spring clip is widened to such an extent in this installation step, that it has an resultant large size to assure that sufficient prestress remains for the retention feature.

SUMMARY OF THE INVENTION

Therefore, the primary object of the present invention is to provide a spring clip capable of being installed in a simple manner while retaining the prestress required for its function.

In accordance with the present invention, the opposite end from the bent-off end of the spring clip bears against the outside surface of the housing section extending tangentially and diametrically opposite the bent-off end of the spring clip.

In the installation of the spring clip, as a first step the first or bent-off end is placed in the guidance region of the housing section and in a second step the spring clip is slid onto the housing section, whereby the second end bears with prestress against the outside surface of the housing section diametrically opposite the first end. The spring clip can be designed exclusively to achieve the prestress as far as its dimensions are concerned, so that easy assembly is afforded, and, in addition, the spring clip can have a small size.

To obtain a twin sided and, therefore, uniform engagement of the spring clip against shoulders on the guide tube, preferably two spring clips are arranged one against the other with their first and second ends alternately arranged on opposite sides of the housing section whereby the two clips forms a clip pair. Accordingly, tilting while intercepting the guide tube is avoided. Advantageously, the pair of clips is secured as a structural unit in the housing against any axial displacement. For the sake of simplicity, the two spring clips can be held together forming a pair of clips within a cage or recess in the housing, so that no special retaining means are required for the clips.

By using a pair of clips, the retaining force required for the guide tube is supplied in halves by each of the spring clips. Consequently, the springs can be dimensioned smaller than a single spring clip which would have to supply the entire holding force. To facilitate the shaping of the first end of each spring clip of the pair, which first end coacts with the shoulder in the recess of the guide tube, thereby facilitating the cooperation with the shoulder, the axial extent of the first end of each spring clip corresponds appropriately to the axial extent of the pair of clips.

In the assembled position, the first end of one spring clip extends along the axial dimension of the other spring clip of the pair. Both spring clips forming the pair can have the same shape and can be assembled reversed one to the other. The portions of the first ends facing toward the trailing end of the tool are located in the same plane and provide a uniform contact with the shoulders of the guide tube.

The inwardly facing or free edge of the first end of the spring clips is preferably provided with a convex shape forming a control curve or cam. The curved control cam formed by the free edge permits displacement of the guide tube in the driving direction, that is, toward the leading end of the tool, overcoming the prestress of the spring clips with very little wear of the guide tube. The shoulders at the trailing end of the recesses in the guide tube drive the first ends radially outwardly, whereby the curved control cam assures that a force readily supplied by the operator is adequate for the displacement of the guide tube.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
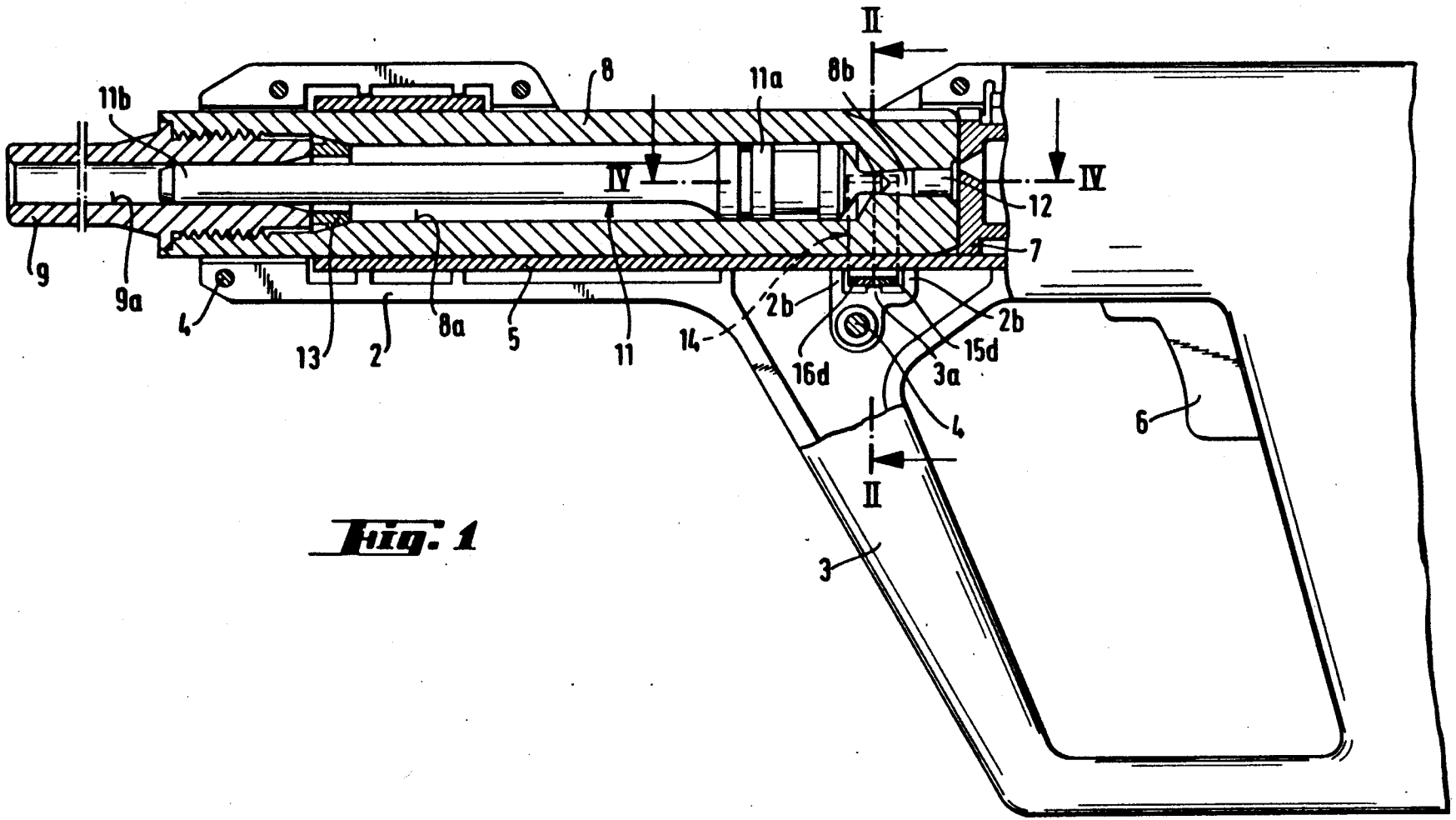
FIG. 1 is a side view, partly in section, of an explosive powder charge operated driving tool embodying the present invention.
Figure 2:
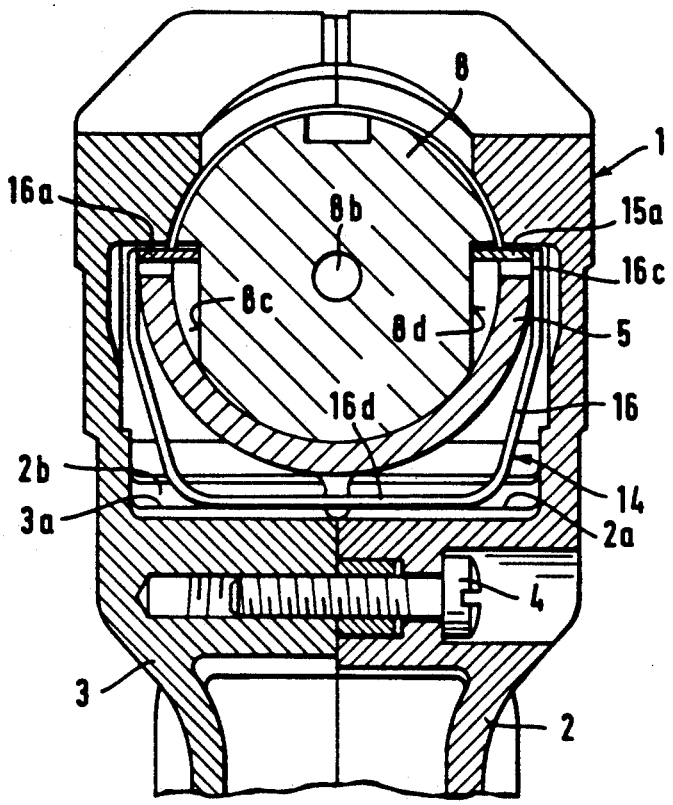
FIG. 2 is an enlarged sectional view taken along the line II—II in FIG. 1.

In FIG. 1 an explosive powder charge operated driving tool is illustrated having a housing 1. The leading end of the housing 1 and of the individual parts of the tool are located to the left in FIG. 1 and the trailing end is located to the right. As shown in FIG. 2, housing 1 is formed of two outer half shells 2, 3 fastened together by screws 4. A generally tube-shaped housing section 5 is retained against axial displacement in the half shells 2, 3. As can be seen in FIGS. 1 and 2, the housing section 5 is not fully cylindrical for its full axial length. Half shells 2, 3 form a handle containing a trigger for initiating the driving process.

A lock piece 7 is displaceably supported within the housing section 5. In the neutral position of the driving tool as shown in FIG. 1, a guide tube 8, displaceably supported in the housing section, bears at its trailing end against the lock piece 7. In the region of the leading end of the guide tube 8, a muzzle tube 9 is secured to and extends axially from the guide tube. A driving piston 11 is located within a bore 8*a* of the guide tube 8 and extends axially into a bore 9*a* in the muzzle tube 9. Driving piston 11 has a head 11*a* supported in the bore 8*a* of the guide tube 8 and a shaft 11*b* extending axially from the head into the bore 9*a* of the muzzle tube 9. At its trailing end, bore 8*a* of the guide tube communicates with a firing chamber 8*b* for an explosive powder charge 12 at the trailing end of the guide tube. Within the bore 8*a* of the guide tube, at the trailing end of the muzzle tube 9, there is a deformable stop ring 13 for intercepting the driving piston 11 as it is propelled in the driving direction by the gases generated when the explosive powder charge is ignited or fired.

Figure 3:
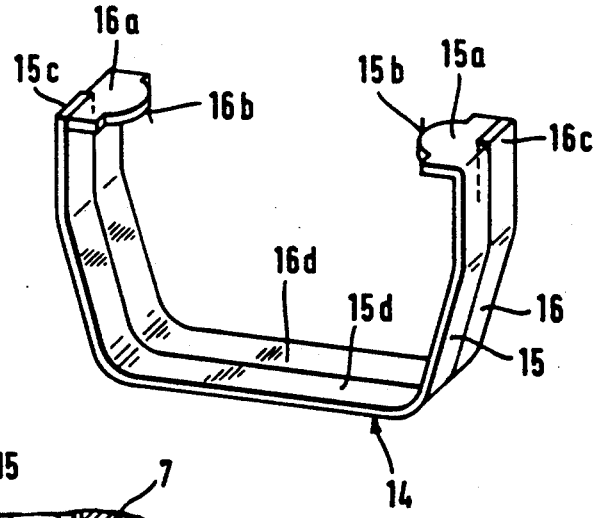
FIG. 3 is a prospective view of a pair of clips illustrated on an enlarged scale as compared to FIG. 1.

In the neutral position of the driving tool, as shown in FIG. 1, the guide tube 8 is held by a pair of clips 14, note FIG. 3. The pair of clips 14 is made up of two U-shaped spring clips 15, 16. Each spring clip 15, 16 has a first end 15*a*, 16*a* bent radially inwardly relative to the leg of the clip. The axial dimension of the first ends 15*a*, 16*a* corresponds to the full axial dimension of the pair of clips 14. The radially inner edge 15*b*, 16*b* of each first end 15*a*, 16*a* has a convex shape. The convexly shaped free inner edges 15*b*, 16*b* provide a cam-like contour. The opposite second ends 15*c*, 16*c* of the spring clips interfit with the other first end 16*a*, 15*a*, note FIG. 3.

Figure 4:
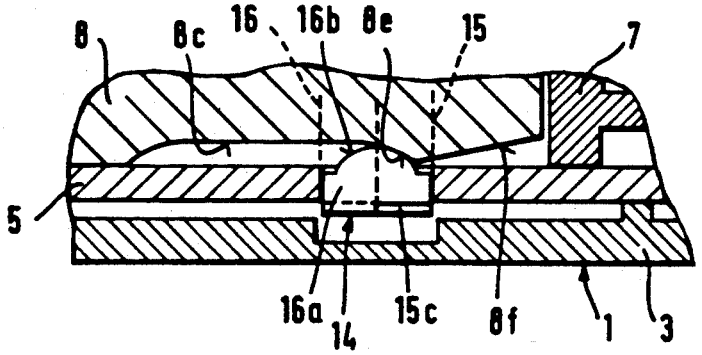
FIG. 4 is an enlarged detail sectional view of the driving tool in FIG. 1 taken along the line IV—IV with the first end of one spring clip shifted into the sectional plane.

The pair of clips laterally embraces the housing section 5 and at the bight or base portions 15*d*, 16*d* engage in a recess or cage 2*a*, 3*a*, formed by the half shells 2, 3. As shown in FIG. 2, the first ends 15*a*, 16*a* project radially inwardly into the guidance region of the housing section 5, while the second ends 15*c*, 16*c* bear with prestress on the outer surface of the housing section 5 diametrically opposite the first end of the corresponding spring clip, as indicated in FIG. 2. The opposite ends in the axial direction of the recess 2*a*, 3*a* form support shoulders 2*b*, 2*b* for holding the pair of clips, so they can not be displaced in the axial direction, note FIG. 1. The convexly shaped free inner edges 15*b*, 16*b* of the first ends 15*a*, 16*a* extend into axially extending recesses 8*c*, 8*d* on the opposite sides of the guide tube 8 with these recesses extending in the axial direction. Each of the recesses 8*c*, 8*d* has a shoulder 8*e* at its trailing end. At its trailing end, the guide tube 8 has run-out bevels 8*f*, as shown in FIG. 4.

To install the pair of clips 14, the spring clips 15, 16 are placed individually upon the housing section 5 and initially the first ends 15*a*, 16*a* are inserted in the guidance region within the housing section 5 so that they project radially inwardly from the housing section. Subsequently, the second ends 15*c*, 16*c* are slid separately onto the outside surface of the housing section 5. The prestress developed in this assembly operation affords a detent force for retaining the guide tube 8 in the neutral position. Accordingly, the first ends 15*a*, 16*a* bear against the shoulders 8*e* at the trailing ends of the recesses 8*c*, 8*d* and hold the guide tube against the lock piece 7. The guide tube 8 can be displaced toward the leading end of the housing 1 for placing a new explosive powder charge 12 into the cartridge chamber 8*b*. In the displacement of the guide tube 8, the first ends 15*a*, 16*a* of the spring clips 15, 16 are displaced out of the recesses against the prestress force by the shoulders 8*e*. When the guide tube 8 is returned toward the trailing end of the housing, the run-up bevels 8*f* force the first ends 15*a*, 16*a* radially outwardly until the first ends snap back into the axially extending recesses 8*c*, 8*d*.

While a specific embodiment of the invention have been shown and described in detail to illustrate the application of the inventive principles, it will be understood that the invention may be embodied otherwise without departing from such principles.

I claim:

1. An explosive powder charge operated setting tool comprising a housing (1) having a leading end and a trailing end, a guide tube (8) axially displaceably mounted in said housing and having a leading end and a trailing end, a driving piston (11) having a leading end and a trailing end axially displaceably supported within said guide tube (8), an axially extending cylindrically shaped housing section (5) having a leading end and trailing end and at least partially laterally enclosing said guide tube (8), an U-shaped spring clip means (15, 16) enclosing and in prestressed contact with said housing section (5) held in said housing (1) for securing said guide tube (8) in a first position, said U-shaped spring clip means (15, 16) extending transversely of the leading end-trailing end direction having a first end (15*a*, 16*a*) located on one side of said housing section and a second end (15*b*, 16*b*) located on an opposite side of said housing section (5), the first end (15*a*, 16*a*) extending radially inwardly from said housing section (5) into an axially extending recess (8*c*, 8*d*) in said guide tube (8), said second end (15*b*, 16*b*) of said spring clip means extends tangentially of and in prestressed contact with an outside surface of said housing section (5) diametrically opposite the first end (15*a*, 16*a*) thereof.

2. An explosive powder charge operated setting tool, as set forth in claim 1, wherein said spring clip means comprises a pair of U-shaped spring clips (15, 16) arranged one contiguous to the other in the leading end-trailing end direction with the first end of one spring located on the opposite side of said housing section from the other first end of the other spring clip.

3. An explosive powder charge operated setting tool, as set forth in claim 2, wherein said pair of clips (15, 16) is held within said housing as a unit whereby said pair of clips is held against displacement in the leading end-trailing end direction, and the leading end-trailing end dimension of the first end (15*a*, 16*a*) of each said spring clip (15, 16) is equal to the leading end-trailing end dimension of the pair of spring clips (15, 16).

4. An explosive powder charge operated setting tool, as set forth in claim 3, where each of said first ends (15*a*, 16*a*) of said spring clips (15, 16) has an inwardly facing free edge (15*b*, 16*b*) and said free edge is convexly curved in the leading end-trailing end direction forming a control cam.

* * * * *